US005616882A

United States Patent [19]

Nichols et al.

[11] Patent Number: 5,616,882

[45] Date of Patent: Apr. 1, 1997

[54] HIGH ENERGY ROCKET PROPELLANT

[75] Inventors: Robert Nichols, Lancastor; Timothy A. McKelvey, Edwards AFB; Stephen L. Rodgers, Pearblossom, all of Calif.

[73] Assignee: The United States of America as represented by the Secretary of the Air Force, Washington, D.C.

[21] Appl. No.: 625,026

[22] Filed: Mar. 29, 1996

Related U.S. Application Data

[63] Continuation of Ser. No. 353,854, Dec. 9, 1994, abandoned.

[51] Int. Cl.[6] ..... C06D 5/02; C06D 5/04; C06D 5/06

[52] U.S. Cl. ..... 102/287; 149/1; 149/74; 149/109.2

[58] Field of Search ..... 102/287; 149/1, 149/74, 109.2

[56] References Cited

U.S. PATENT DOCUMENTS

| | | | |
|---|---|---|---|
| 1,551,650 | 9/1925 | Egloff . | |
| 2,759,418 | 8/1956 | Ross et al. | 102/24 |
| 2,886,424 | 5/1959 | Hyslop | 52/1 |
| 3,615,285 | 10/1971 | Whitney et al. | 44/7 |
| 3,660,183 | 5/1972 | Knowles et al. | 149/21 |
| 3,755,020 | 8/1973 | Durfee | 149/20 |
| 4,762,092 | 8/1988 | Yuasa et al. | 123/1 A |
| 5,076,813 | 12/1991 | Alberici et al. . | |

*Primary Examiner*—Charles T. Jordan
*Assistant Examiner*—John R. Hardee
*Attorney, Agent, or Firm*—Thomas C. Stover

[57] ABSTRACT

A rocket propellant of improved Isp and thrust is provided by modifying a rocket fuel of RP-1 (a kerosene fraction). Such fuel is combined with an oxidizer (e.g. liquid oxygen, LOX) which defines a rocket propellant of the prior art. Such propellant is modified per the invention by addition to or replacement of, the RP-1 with quadricyclane. In another embodiment, quadricyclane is added to n-Hexane as a fuel composition which is then combined with an oxidizer to define a rocket propellant per the invention. The invention thus provides a number of rocket fuels which upon combination with an oxidizer, provides a high energy density propellant, which can permit increases of over 10 wt % in additional payload for rocket launch vehicles.

17 Claims, No Drawings

HIGH ENERGY ROCKET PROPELLANT

STATEMENT OF GOVERNMENT INTEREST

The invention described herein may be manufactured and used by or for the Government for governmental purposes without the payment of any royalty thereon.

This application is a continuation, of application Ser. No. 08/353,854, filed 9 Dec. 1994, now abandoned.

BACKGROUND OF THE INVENTION

1. Field of the Invention

This invention relates to a high energy rocket propellant particularly a liquid composition containing liquid quadricyclane.

2. The Prior Art

Currently, RP-1 (a preferred kerosene formulation) in combination with liquid oxygen (LOX) is used as the propellant system in a large percentage of launch vehicles or rockets. The current payloads of these vehicles are limited by the density and energy content of these propellants. It is therefore desirable to improve rocket propulsion by improving the rocket fuel to increase the payload for rocket launch vehicles.

As further described below, the present invention proposes to add a heptane known as quadricyclane to rocket fuel to improve the performance thereof.

Quadricyclane or tetracyclo-[2.2.1.0-(2,6).0-3,5]-heptane, is known in the prior art as a solar energy storage chemical, as set forth in e.g. T. Laird, *Chem. Ind.* (London) p. 186 (1978), which is incorporated herein by reference. More recently quadricyclane has been added to fuel for internal combustion engines, as set forth in U.S. Pat. No. 5,076,813 to F. Alberici et al (1991), which is incorporated herein by reference. In such patent, quadricyclane is added to gasoline or toluene and enhanced combustion is noted.

However in internal combustion engines, air is the major working fluid and the fuel mixture that works in such engine may not work well in a rocket engine. That is in a rocket engine, rocket fuel is burned in the presence of liquid oxygen and the combustion products become the working fluid and different operating kinetics apply.

Accordingly there is need and market for a rocket fuel that provides improved thrust for rockets over that presently available in the prior art.

There has now been discovered an improved rocket propellant or fuel that increases payload capability for rocket launch vehicles.

SUMMARY OF THE INVENTION

Broadly the present invention provides a rocket propellant of improved Isp which includes quadricyclane Q, and/or its alkyl-substituted derivatives or a combination thereof or Q and at least one other fuel component. Such other fuel component can be an alkyl having 1–20 carbon atoms, an aryl having 3–20 carbon atoms, kerosene, RP-1, Hexane, n-Hexane or a combination of two or more thereof.

By quadricyclane as used herein is meant a compound having the formula:

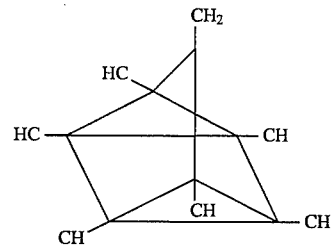

By RP-1 as used herein is meant, a selected kerosene fraction that is subjected to acid washing and $SO_2$ extraction. The so-washed and extracted kerosene fraction includes paraffins, naphthalene and aromatics. For a further discussion of RP-1, see Military Specification MIL-R-25576B, incorporated herein by reference.

DESCRIPTION OF PREFERRED EMBODIMENTS

As discussed further below, per the present invention, quadricyclane is suitably used as an additive to or replacement for, RP-1 or kerosene as a rocket propellant. Quadricyclane can also be used in combination with other hydrocarbons, e.g. having from 1–20 carbon atoms, as an additive to or replacement for RP-1 or kerosene. It is believed that the best application of the fuel mixture of the invention is as a propellant to increase payload for rocket launch vehicles.

To test the fuel composition of the present invention, rocket engine tests have been run using gaseous oxygen (GOX) as the oxidizer and with:

1) pure RP1 as the baseline or 2) pure quadricyclane as the rocket fuel, or 3) a combination of 50 wt % quadricyclane with 50 wt % RP-1 or 4) a combination of 65 wt % quadricyclane with 35 wt % n-Hexane as the respective test fuels.

It was found that when pure quadricyclane was employed as the fuel, combustion was rough compared to the RP-1 baseline test. When RP-1 or n-Hexane were added, as stated in the above formulations, the combustion became smooth and the measured performance exceeded that of the RP-1 baseline test.

The use of other hydrocarbons like n-Hexane in combination with quadricyclane, allows the density of the propellants to be tailored to a given propulsion system while maintaining a higher level of specific impulse (Isp) than that available when just the above baseline fuel is employed.

As indicated above, a large percentage of current launch vehicles use (LOX/RP-1 or Kerosene) as the propellant system. By the addition to or replacement of, RP-1 with quadricyclane, increases in payload delivered to orbit can be gained. Increases of over 10 wt % in additional payload can be attained with the use of quadricyclane.

For example on an Atlas, IIAS, a currently used U.S. launch vehicle, the payload can be increased by 1758 lbs to low earth orbit (LEO) and by 954 lbs to GEO Transfer Orbit (GTO), if quadricyclane be used as a replacement for RP-1. For a vehicle like an Atlas II, only a small amount of quadricyclane can be added to the RP-1 before the thrust-to-weight limit is exceeded, due to the high density of quadricyclane. However by using n-Hexane, which has a lower density but higher Isp than RP-1, in place of some or all of the RP-1, the amount of quadricyclane (added) can be markedly increased without decreasing the thrust-to-weight ratio.

Now with the higher Isp of n-Hexane and the additional quadricyclane that can be added to the above mixture, an overall higher specific impulse and payload is obtained than can be realized with just RP-1 and quadricyclane. With the above formulations for quadricyclane and n-Hexane [e.g. per composition (4) above], the payload is increased by 804 lbs to LEO and by 440 lbs to GTO.

Accordingly the propellant of the present invention as summarized above and claimed below, can include the following compositions:

1) 100% quadricyclane

2) Q/RP-1 in a range of 95–5 to 5–95 wt. % for either component and preferably in a 50—50 wt. % composition, 3) Q/n-Hexane in a range of 95–5 to 5–95 wt. % for either component and preferably in a composition of 65 wt. % Q and 35 wt. % n-Hexane, 4) Q/RP-1/n-Hexane in a range of 95–5 to 5–95 wt % for the respective components and preferably in a composition of 33⅓ wt. % for each of the three components and 5) Q/and an alkyl having 1–20 carbon atoms. Such alkyls can include alkanes, alkenes, alkynes, aryls, and arenes or groups thereof and can have single, double or triple bonds between at least a pair of carbon atoms therein.

Now the above fuels of the invention are employed with an oxidizer in a rocket engine to form the rocket propellant therefor. Such oxidizers can be, e.g. liquid oxygen (LOX), $H_2O_2$ or $N_2O_4$.

The oxidizers (which are not part of the present invention), are added to the above fuels in the following mass ratios of oxidizer/fuel.

a) The oxidizer LOX is added to a fuel of the invention in the mass ratio of 1.5/1 to 3/1 and preferably in the ratio of 2.0/1 to 2.6/1, b) The oxidizer $H_2O_2$ is added to a fuel embodying the invention in a mass ratio of 4/1 to 8/1 and preferably in a ratio of 5/1 to 7/1 and c) the oxidizer $N_2O_4$ is added to a fuel of the invention in a mass ratio of 2/1 to 4/1 and preferably in a ratio of 3/1 to 3.5/1.

The following example is intended as an illustration of the preparation of a rocket propellant composition according to the present invention and should not be construed in limitation thereof.

EXAMPLE I

Specific Impulse (Isp) is the key measure of performance for a rocket propellant system. It is the amount of thrust generated over the propellant mass consumed per unit time. Propellant system density (RHOsys), is also an important propellant system performance factor but does not weigh as heavily as Isp. A One Dimensional Equilibrium (ODE) Isp code was used to calculate the performance of Quadricyclane, mixtures of quadricyclane (Q), and RP-1 as a baseline, with Liquid Oxygen (LOX) as the oxidizer for the above fuels. Normal Hexane (n-Hexane or n-H) $C_6H_{14}$ is a lower density higher Isp compound that was used to tailor the weight density to match current launch systems while maintaining a high level of Isp. Mixture Ratio mass basis (MR(m)) is the Oxidizer mass over the fuel mass while Mixture Ratio volume basis MR(vol) is oxidizer volume over the fuel volume. These results are shown in the Table below.

TABLE I

| PROPELLANT | Isp (sl) | MR (m) | MR (vol) | RHO (sys-sl) |
|---|---|---|---|---|
| RP-1 | 300 | 2.5 | 1.75 | 1.029 |
| 50% Q/50% RP-1 | 303 | 2.3 | 1.79 | 1.057 |
| 65% Q/35% n-H | 305 | 2.3 | 1.69 | 1.034 |
| 100% Q | 307 | 2.0 | 1.71 | 1.089 |

As can be seen from the above Table, the mixtures with quadricyclane have superior Isp and propellant system weight density (which can permit a smaller fuel tank and thus a smaller launch vehicle) compared to RP-1. It should also be noted that volumetric mixture ratios are very close to that of LOX/RP-1 an important factor when substituting these fuels for RP-1 into existing vehicle tanks since the majority of the launch system mass and volume is composed of propellant, typically more than 75%.

As noted above, combustion of 100% (or pure) quadricyclane was rough compared to the RP-1 baseline fuel. Subsequent tests with:

1) 50 wt. % quadricyclane mixed with 50 wt. % RP-1 and/or 2) 65 wt. % quadricyclane mixed with 35 wt. % n-Hexane, stabilized the combustion and displayed increased performance, superior to the RP-1 baseline fuel.

Measurements of the density of quadricyclane show it to be greater than that of RP-1. Thus the present invention provides a high energy and density rocket propellant composition containing quadricyclane i.e., tetracyclo-[2.2.1.0-(2,6).0-3,5]-heptane, as a high performance rocket engine fuel.

The use of a quadricyclane containing propellant per the invention, allows a larger amount of energy to be stored per propellant unit volume and per unit mass, than current conventional rocket propellants.

Thus the rocket propellant composition of the invention is suitable for any rocket propulsion system requiring more energetic propellants for increased Isp. Any space-based application requiring a fuel of high energy content per unit mass or unit volume, can benefit from this technology. Examples of other applications include lasers and power generation systems.

What is claimed is:

1. A fuel for rockets comprising, at least 5 weight % quadricyclane (Q), its alkyl-substituted derivatives or a combination thereof and at least one fuel component selected from the group consisting of alkanes, alkenes and alkynes having 1–20 carbon atoms; RP-1, Hexanes, n-Hexane, kerosene and a combination thereof and an oxidizer for said fuel.

2. The fuel of claim 1 wherein said fuel component is selected from the group consisting of RP-1, Hexanes, n-Hexane, kerosene and a combination thereof.

3. The fuel of claim 2 wherein said component is present in the range of 5–95 wt. %.

4. The fuel of claim 2 wherein said component is present in the range of 65 to 35 wt. %.

5. The fuel of claim 2 wherein said component is present in the amount of at least 50 wt. %.

6. The fuel of claim 2 wherein Q and Hexane are present in a 1:1 wt. ratio and kerosene is present in a 5–95 wt. ratio relative to the sum of said Q and Hexanes.

7. The fuel propellant of claim 1, wherein said RP-1 is present in the amount of 5–95 wt. %, said Hexanes are present in the amount of 5–95 wt. %, said kerosene is present in the amount of 5–95 wt. % and the balance thereof in each case includes Q or an alkyl-substituted derivative thereof.

8. The fuel of claim 4, having a combination of 65 wt. % Q and 35 wt. % n-Hexane.

9. The fuel of claim 5, having a combination of 50 wt. % Q and 50 wt. % RP-1.

10. The fuel of claim 6 having a combination of 33⅓ wt. % Q, 33⅓ wt. % RP-1 and 33⅓ wt. % n-Hexane.

11. The rocket fuel of claim 2, wherein said alkyl contains at least a pair of carbons united by a single, double, or triple bond.

12. The fuel of claim 2 mixed with an oxidizer selected from the group consisting of liquid oxygen (LOX), $H_2O_2$ and $N_2O_4$.

13. The fuel of claim 12 wherein the oxidizer to fuel-mixture ratio on a mass basis is 1.5/1 to 8/1.

14. The fuel of claim 12 wherein the oxidizer to fuel-mixture ratio on a mass basis is 2/1 to 2.6/1.

15. A method for increasing potential thrust in a rocket engine, when ignited, comprising adding at least 5 weight % quadricyclane, its alkyl-substituted derivatives or a combination thereof to a component selected from the group consisting of RP-1, Hexanes, n-Hexane, kerosene and combinations thereof and adding same to said engine.

16. The method of claim 15, wherein 5–95 wt. % quadricyclane is added to a component selected from the group consisting of RP-1, Hexane, n-Hexane and kerosene.

17. A method for preparing a fuel for rockets of increased thrust comprising, adding at least 5 weight % quadricyclane, its alkyl-substituted derivatives or a combination thereof to a component selected from the group consisting of RP-1, Hexanes, n-Hexane, kerosene and combinations thereof.

* * * * *